US007253561B2

(12) United States Patent
Kim et al.

(10) Patent No.: US 7,253,561 B2
(45) Date of Patent: Aug. 7, 2007

(54) PLASMA DISPLAY PANEL INCLUDING DOPANT ELEMENTS SI AND FE

(75) Inventors: Ki-Dong Kim, Cheonan (KR); Eun-Gi Heo, Cheonan (KR); Young-Cheul Kang, Cheonan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 222 days.

(21) Appl. No.: 10/791,197

(22) Filed: Mar. 2, 2004

(65) Prior Publication Data

US 2004/0183441 A1 Sep. 23, 2004

(30) Foreign Application Priority Data

Mar. 4, 2003 (KR) ..... 10-2003-0013421

(51) Int. Cl.
*H01J 17/49* (2006.01)

(52) U.S. Cl. ..... 313/587

(58) Field of Classification Search ..... 313/582–587
See application file for complete search history.

(56) References Cited

U.S. PATENT DOCUMENTS

| | | | | |
|---|---|---|---|---|
| 6,437,506 | B1 * | 8/2002 | Mitamura et al. | 313/586 |
| 6,525,471 | B2 * | 2/2003 | Bachmann et al. | 313/587 |
| 6,879,107 | B2 * | 4/2005 | Hirano et al. | 313/587 |
| 2004/0070341 | A1 * | 4/2004 | Chul Park | 313/582 |
| 2004/0131884 | A1 * | 7/2004 | Park et al. | 428/690 |
| 2005/0045065 | A1 * | 3/2005 | Sakurai et al. | 106/286.8 |

FOREIGN PATENT DOCUMENTS

| | | | |
|---|---|---|---|
| CN | 2395380 Y | | 9/2000 |
| EP | 82102225 A2 | * | 11/1982 |
| JP | 10-334809 | | 12/1998 |
| JP | 11-339665 | * | 12/1999 |
| JP | 2000-63171 | | 2/2000 |

OTHER PUBLICATIONS

Derwent Abstract for Korean Patent to Ahn, SI, (Derwent Acc No. 2002-250998), Korean Patent No. (KR 2001046093A), Published Jun. 5, 2001.*

Patent Abstracts of Japan for Publication No. 10-334809, Publication Date Dec. 18, 1998.

Patent Abstracts of Japan for Publication No. 2000-063171; Date of publication of application Feb. 29, 2000, in the name of Takeyoshi Takenouchi et al.

* cited by examiner

*Primary Examiner*—Edward J. Glick
*Assistant Examiner*—Anastasia S. Midkiff
(74) *Attorney, Agent, or Firm*—Christie, Parker & Hale, LLP

(57) ABSTRACT

Disclosed is a plasma display panel including a first substrate and a second substrate provided with a predetermined gap therebetween, and disposed substantially parallel to each other; a plurality of address electrodes formed on the first substrate; a first dielectric layer formed on a front surface of the first substrate, covering the address electrodes; a plurality of barrier ribs mounted on the first dielectric layer with a predetermined height to provide a discharge space; a phosphor layer formed within the discharge space; a plurality of discharge sustain electrodes provided on a front surface of the second substrate facing the first substrate, and disposed generally perpendicular to the address electrodes; a second dielectric layer formed on the front surface of the second substrate, covering the discharge sustain electrodes; and a passivation layer coated on the second dielectric layer, comprising MgO and dopant elements Si and Fe.

4 Claims, 4 Drawing Sheets

PLASMA DISPLAY PANEL INCLUDING DOPANT ELEMENTS SI AND FE

CROSS REFERENCE TO RELATED APPLICATION

This application claims priority of Application No. 2003-13421 filed in the Korean Intellectual Property Office on Mar. 4, 2003, the disclosure of which is incorporated herein by reference.

FIELD OF THE INVENTION

The present invention relates to a plasma display panel, and more particularly to a plasma display panel in which the display has improved quality and a shorter statistical delay.

DESCRIPTION OF THE RELATED ART

A plasma display panel is a flat display device using a plasma phenomenon, which is also called a gas-discharge phenomenon since a discharge is generated in the panel when a potential greater than a certain level is applied to two electrodes separated from each other under a gas atmosphere in a non-vacuum state. The gas discharge phenomenon is applied to display an image, and the panel has a fundamental matrix structure in which the discharged gas is filled between two substrates, and electrodes are alternatively disposed facing each other on the substrates.

Such a plasma display device is available as either a direct current (DC) type or an alternating current (AC) type, and the latter is more widely employed.

The AC plasma display device has a fundamental structure in which the discharge gas is filled between two substrates, and electrodes are alternatingly disposed facing each other on the substrates with barrier ribs. One electrode is coated with a dielectric layer to generate a wall charge, and the other electrode is provided with a phosphor layer.

Since electrodes, barrier ribs, dielectric layers, and so on are typically prepared by a printing process due to its low cost, the layer becomes thicker than with other processes. The formation states of a thick film layer are inferior to those of a thin layer process.

A problem that is caused by such a thick film layer is damage to the dielectric layer and the lower electrode by electron and ion sputtering generated from the discharge, so that the life span of an AC plasma display device is shortened.

In order to reduce the ion attack effect upon discharge, a passivation layer with a thickness of several hundred nm is provided on the dielectric layer. Generally, the passivation layer is made with MgO. A MgO passivation layer is capable of reducing the discharge voltage and protecting the dielectric layer from the sputtering so that the life span of the AC plasma display device is prolonged.

However, with this passivation layer it is hard to maintain the display quality since its characteristics vary remarkably with the film formation conditions such as heating and depositing processes. In addition, the passivation layer tends to cause an address miss and black noise resulting from an address discharge delay time such that a cell to be selected to emit light does not work. The black noise is easily generated in certain areas such as at the interface between the emission region and the non-emission region in a screen. The address miss phenomenon is found when no address discharge occurs or even when the intensity is weak upon performing the address discharge.

In order to prevent these problems, the address discharge delay time has been studied with respect to the MgO morphology, and the results thereof are shown in FIG. 1. As shown in FIG. 1, the discharge delay time is a little shorter when the MgO morphology corresponds to a sintered body, and the delay is moderated in proportion to an increase in the temperature, but the discharge delay time is still more than 1600 ns at a temperature of −30° C. or less.

Japanese Patent Laid-open Publication No. Hei. 10-334809 discloses a MgO passivation layer comprising 500 to 10,000 ppm of Si. However, the publication still fails to satisfy the requirements relating to the discharge delay time.

SUMMARY OF THE INVENTION

The present invention provides a passivation layer composition for a plasma display panel in which the display has improved quality and a shortened statistical delay. The present invention also provides a plasma display panel comprising a passivation layer fabricated from the composition.

In one embodiment, the present invention provides a plasma display panel comprising a first substrate and a second substrate provided with a predetermined gap therebetween and disposed substantially parallel to each other; a plurality of address electrodes formed on the first substrate; a first dielectric layer formed on a front surface of the first substrate, covering the address electrodes; a plurality of barrier ribs mounted on the first dielectric layer with a predetermined height to provide a discharge space; a phosphor layer formed within the discharge space; a plurality of discharge sustain electrodes provided on a front surface of the second substrate facing the first substrate and disposed generally perpendicular to the address electrodes; a second dielectric layer formed on the front surface of the second substrate, covering the discharge sustain electrodes; and a passivation layer coating the second dielectric layer and comprising MgO and dopant elements Si and Fe.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE INVENTION

Embodiments of the present invention will now be described in detail with reference to the accompanying drawings.

The present invention relates to a passivation layer of a plasma display panel. The passivation layer of the plasma display panel according to the present invention comprises a basic material of MgO, and dopant elements Si and Fe. The amount of Si in the passivation layer is preferably from 50 to 500 ppm, and more preferably from 80 to 350 ppm. When the amount of Si is within the above range, the discharge delay time is shortened the most. However, when the Si amount is out of the range, i.e., less than 50 ppm or more than 500 ppm, the discharge delay time is inadvantageously prolonged. The Fe amount preferably ranges from 15 to 90 ppm, and more preferably from 20 to 70 ppm. Since the discharge delay time is controlled according to the Fe amount, if the Fe amount is out of this range, it inadvantageously prolongs the discharge delay time.

Figure 1:
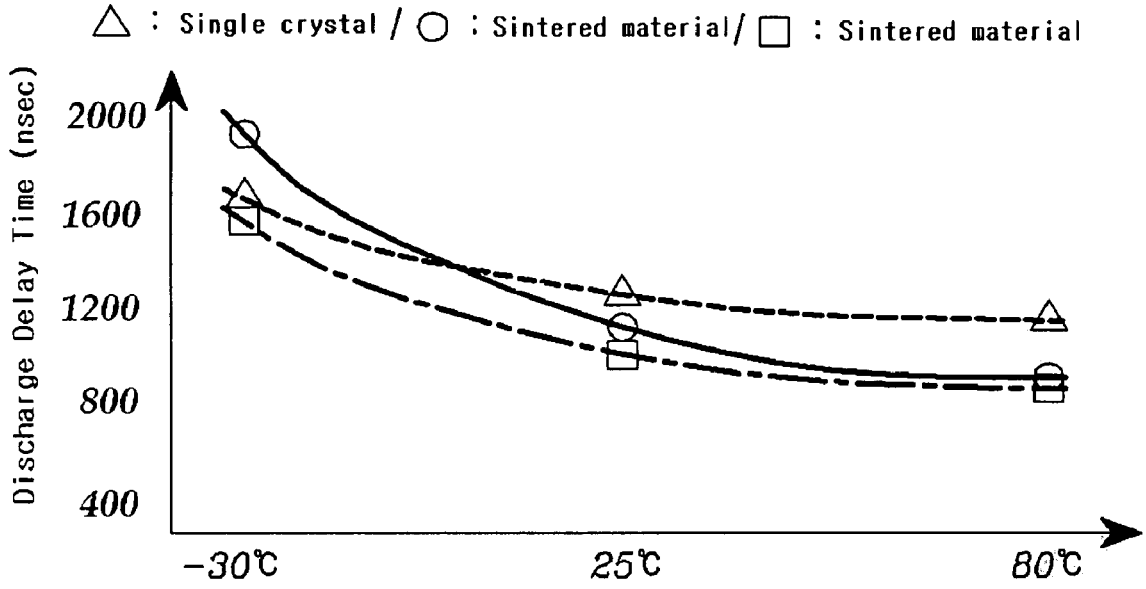
FIG. 1 is a graph showing the discharge delay time relating to the MgO morphology.
Figure 2:
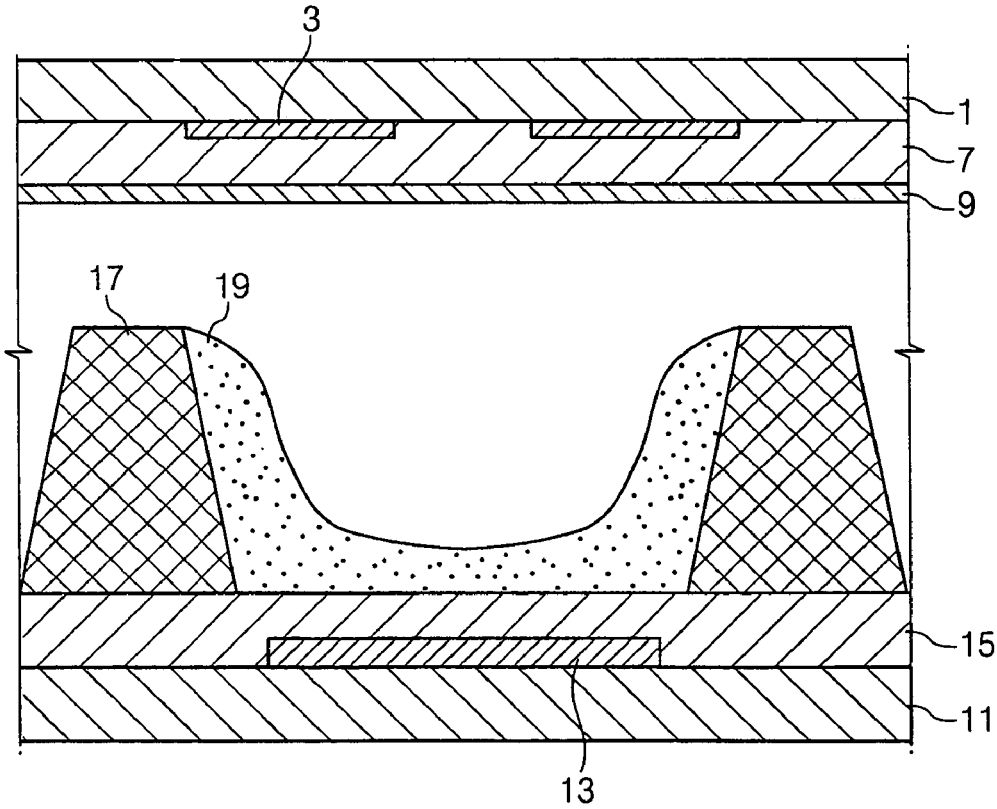
FIG. 2 is a schematic cross-sectional view of a plasma display panel according to the present invention.

FIG. 2 shows an embodiment of plasma display panel including the passivation layer according to the present invention. As shown in FIG. 2, the plasma display panel according to the present invention comprises a first substrate 11 and a second substrate 1 provided with a predetermined gap therebetween, and disposed substantially in parallel to each other (hereinafter the first substrate is referred to as the "lower substrate" and the second substrate is referred to as the "upper substrate"). A plurality of address electrodes 13 are formed on the lower substrate 11, and a dielectric layer 15 is formed on the front surface of the lower substrate 11, covering the address electrodes 13.

A plurality of barrier ribs 17 are mounted on the dielectric layer 15 with a predetermined height to provide a discharge space, and a phosphor layer 19 is formed on the dielectric layer 15 and the side surface of the barrier ribs 17.

Further, a plurality of discharge sustain electrodes 3 are provided on a surface of the upper substrate 1 facing the lower substrate 11 and disposed perpendicularly to the address electrodes 13. Another dielectric layer 7 is formed on the front surface of the upper substrate 1, covering the discharge sustain electrodes 3. A passivation layer 9 including MgO and dopant elements Si and Fe is coated on the dielectric layer 7.

The method for fabricating the plasma display panel having the aforementioned structure according to the present invention is widely known to those having ordinary skill in the art, so details thereof are abridged. However, the method of forming the passivation layer, which is a feature of the present invention, will be described in detail below.

The passivation layer may be obtained by a thick film printing method or a deposition method using plasma. The thick film printing method results in a film that is relatively weak with respect to the ion sputtering attack, which makes it difficult to reduce the discharge sustain voltage and the discharge initiating voltage of the second electron emission. Therefore the passivation layer is preferably prepared by the deposition method.

The plasma deposition method may be applied with, for example, electron beam deposition, ion plating, or magnetron sputtering methods to obtain the passivation layer. In this case, the amount of Si dopant relative to the main material of MgO is preferably from 50 to 500 ppm, and more preferably from 80 to 350 ppm. The amount of Fe dopant is preferably from 15 to 90 ppm, and more preferably from 20 to 70 ppm.

The following examples illustrate the present invention in further detail. However, it is understood that the present invention is not limited by these examples.

Measurement of the discharge delay time depending upon the Fe

EXAMPLE 1

A discharge sustain electrode was fabricated in a stripe shape in accordance with a conventional method, by applying an indium tin oxide conductive material on an upper substrate of soda lime glass.

Then, a front surface of the upper substrate that was provided with the discharge sustain electrode was coated with a lead-based glass paste and sintered to provide a dielectric layer.

To the resulting dielectric layer, a passivation layer comprising MgO, Si, and Fe was applied by a sputtering method to provide an upper panel. The amounts of Si and Fe relative to MgO were 200 ppm and 15 ppm, respectively.

EXAMPLE 2

The upper panel was fabricated by the same method as in Example 1, except that the amount of Fe relative to MgO was 50 ppm.

EXAMPLE 3

The upper panel was fabricated by the same method as in Example 1, except that the amount of Fe relative to MgO was 90 ppm.

COMPARATIVE EXAMPLE 1

The upper panel was fabricated by the same method as in Example 1, except that the amount of Fe relative to MgO was 10 ppm.

COMPARATIVE EXAMPLE 2

The upper panel was fabricated by the same method as in Example 1, except that the amount of Fe relative to MgO was 150 ppm.

Figure 3:
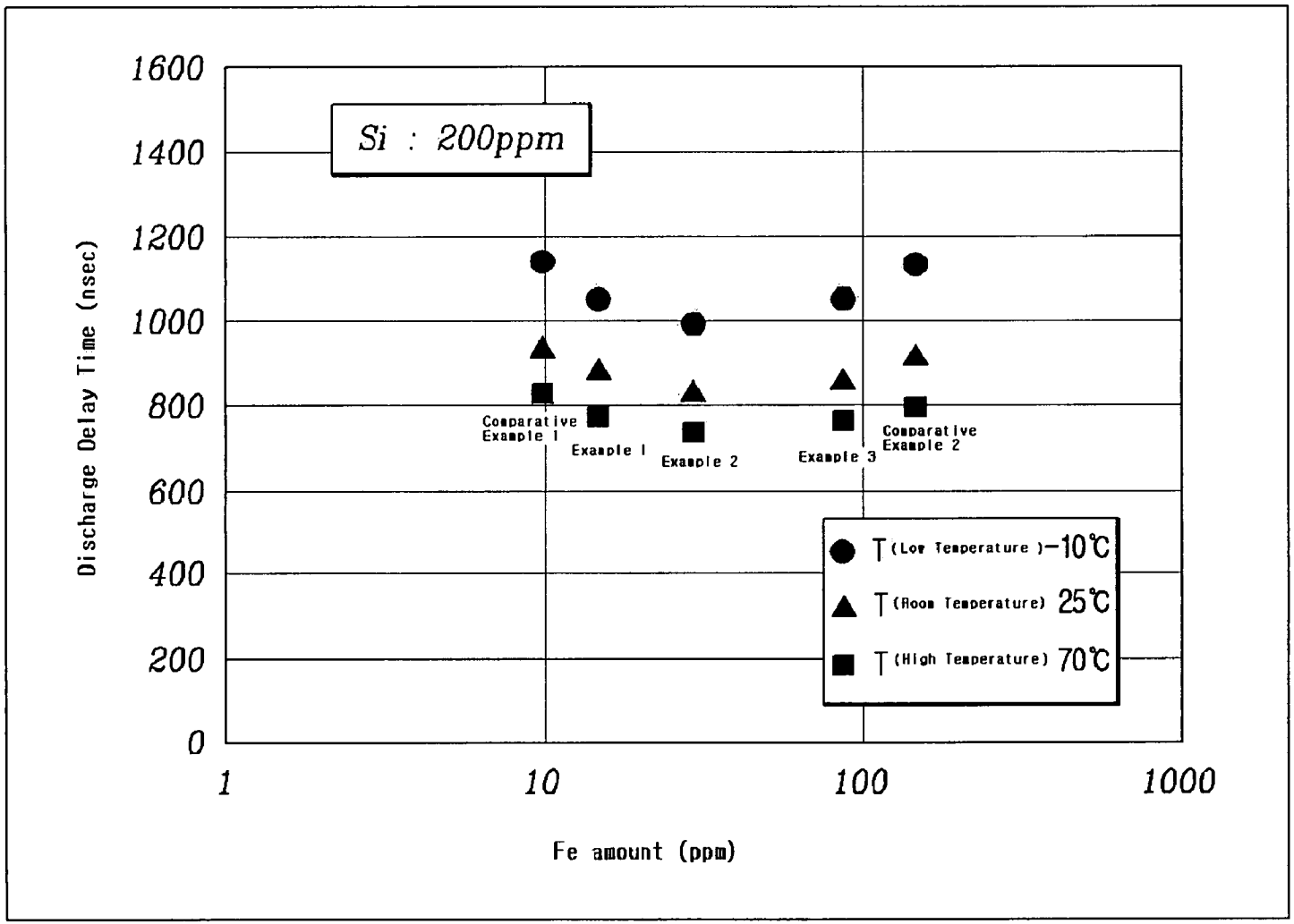
FIG. 3 is a graph showing the discharge delay time according to Examples 1 to 3 of present invention and Comparative Examples 1 and 2.

FIG. 3 shows the discharge delay time depending upon the amounts of Fe in the passivation layers of Examples 1 to 3 and Comparative Examples 1 and 2. As MgO is a material sensitive to a change in ambient temperature, the discharge delay time was measured by operating the obtained display panel at a low temperature (−10° C.), room temperature (25° C.), and a high temperature (70° C.) to determine to what extent the amounts of Si and Fe can reduce the temperature sensitivity of MgO. As shown in FIG. 3, the cases of Examples 1 to 3, in which the Si amount was 200 ppm and the Fe amount fell in the range of 15 to 90 ppm, improved the black noise phenomenon since they shortened the discharge delay time compared to the cases when the Fe amount was 10 ppm (Comparative Example 1) or 150 ppm (Comparative Example 2).

Measurement of the discharge delay time depending upon the Si

REFERENCE EXAMPLE 1

The upper panel was fabricated by the same method as in Example 1, except that the amount of Si relative to MgO was 50 ppm.

REFERENCE EXAMPLE 2

The upper panel was fabricated by the same method as in Reference Example 1, except that the amount of Si relative to MgO was 250 ppm.

REFERENCE EXAMPLE 3

The upper panel was fabricated by the same method as in Reference Example 1, except that the amount of Si relative to MgO was 500 ppm.

REFERENCE EXAMPLE 4

The upper panel was fabricated by the same method as in Reference Example 1, except that the amount of Si relative to MgO was 1500 ppm.

COMPARATIVE EXAMPLE 3

The upper panel was fabricated by the same method as in Reference Example 1, except that the amount of Si relative to MgO was 15 ppm.

COMPARATIVE EXAMPLE 4

The upper panel was fabricated by the same method as in Reference Example 1, except that the amount of Si relative to MgO was 5000 ppm.

Figure 4:
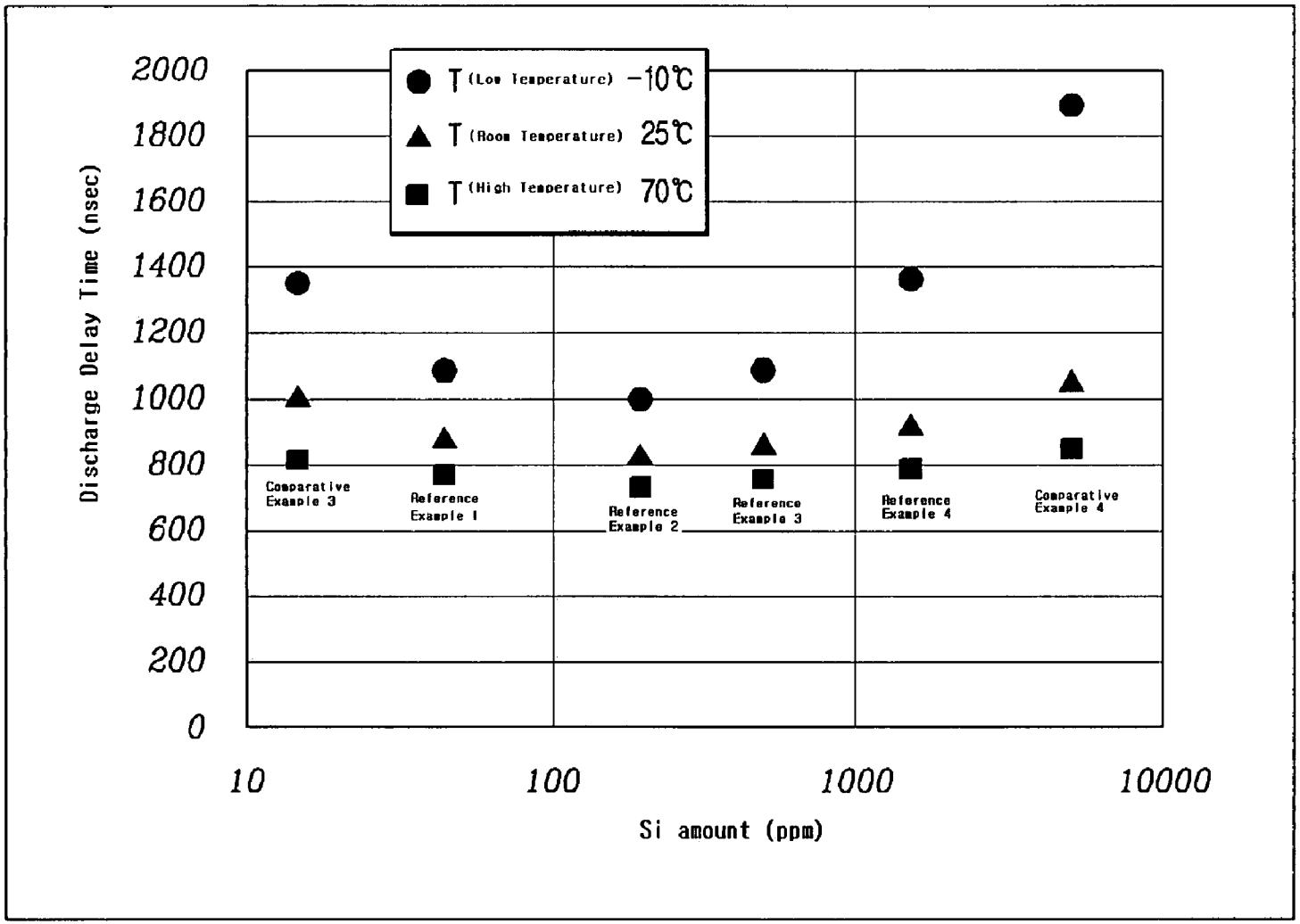
FIG. 4 is a graph showing the discharge delay time according to Reference Examples 1 to 4 of the present invention and Comparative Examples 3 and 4.

The discharge delay time depending upon the amounts of Si in the passivation layers of Reference Examples 1 to 4 and Comparative Examples 3 and 4 were measured, and the results are shown in FIG. 4. As in FIG. 3, the discharge delay time was measured by operating the obtained display panel at −10° C., 25° C., and 70° C. to determine how the ambient temperature affects the discharge delay time.

Figure 5:
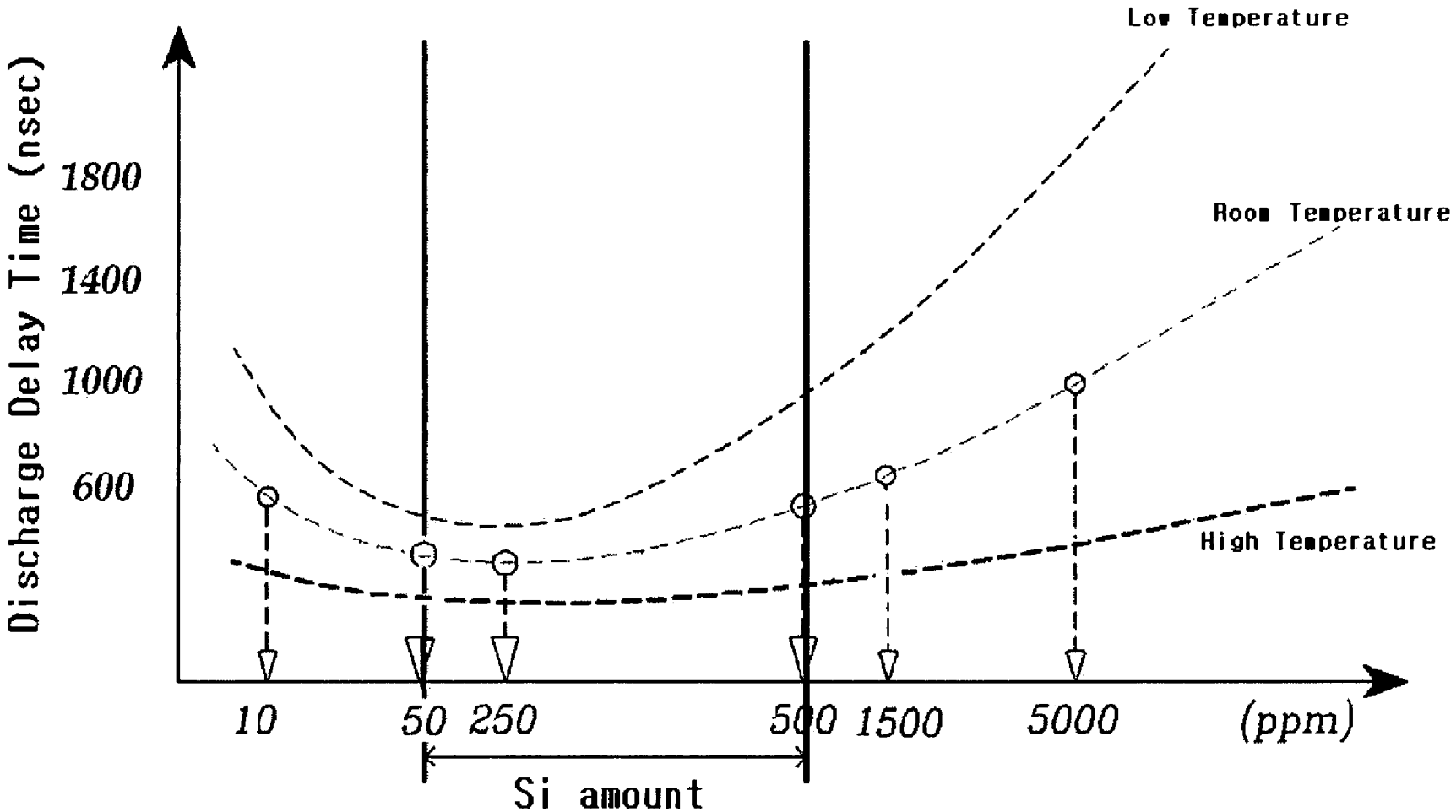
FIG. 5 is a graph showing the discharge delay time according to Reference Examples 1 to 4 of the present invention and Comparative Examples 3 and 4.

In addition, the discharge delay time depending upon the temperature and Si amount were measured for Reference Examples 1 to 4 and Comparative Examples 3 and 4, and the results are shown in FIG. 5. As shown in FIG. 5, if Si is added in an amount from 50 to 500 ppm, the discharge delay time is altered little by a temperature change. Therefore, the resultant display panel exhibits constant display quality regardless of the environment.

As mentioned above, the plasma display panel according to the present invention can improve the display quality because it comprises Si and Fe in a certain range.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A plasma display panel comprising:

a first substrate and a second substrate provided with a predetermined gap therebetween, and disposed substantially parallel to each other;

a plurality of address electrodes formed on the first substrate;

a first dielectric layer formed on a front surface of the first substrate, covering the address electrodes;

a plurality of barrier ribs mounted on the first dielectric layer with a predetermined height to provide a discharge space;

a phosphor layer formed within the discharge space;

a plurality of discharge sustain electrodes provided on a front surface of the second substrate facing the first substrate, and disposed generally perpendicular to the address electrodes;

a second dielectric layer formed on the front surface of the second substrate, covering the discharge sustain electrodes; and a passivation layer coated on the second dielectric layer, comprising MgO and dopant elements Si and Fe, wherein the Fe is provided in an amount ranging from 15 to 90 ppm, and wherein the passivation layer comprises Si in an amount ranging from 50 to 500 ppm.

2. The plasma display panel according to claim 1, wherein the passivation layer comprises Si in an amount ranging from 80 to 350 ppm.

3. The plasma display panel according to claim 1, wherein the passivation layer comprises Fe in an amount ranging from 20 to 70 ppm.

4. The plasma display panel according to claim 3, wherein the passivation layer comprises Si in an amount ranging from 80 to 350 ppm.

* * * * *